US008693923B2

(12) United States Patent
Iida et al.

(10) Patent No.: US 8,693,923 B2
(45) Date of Patent: Apr. 8, 2014

(54) DEVELOPING APPARATUS

(75) Inventors: Takanori Iida, Noda (JP); Tomoyuki Sakamaki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 47 days.

(21) Appl. No.: 13/523,176

(22) Filed: Jun. 14, 2012

(65) Prior Publication Data

US 2012/0321352 A1 Dec. 20, 2012

(30) Foreign Application Priority Data

Jun. 17, 2011 (JP) ..... 2011-135099

(51) Int. Cl.
*G03G 15/08* (2006.01)

(52) U.S. Cl.
USPC ..... 399/254; 399/119

(58) Field of Classification Search
USPC ..... 399/119, 254, 255, 256, 258, 259
See application file for complete search history.

(56) References Cited

U.S. PATENT DOCUMENTS 8,548,361 B2 * 10/2013 Noguchi et al. ..... 399/254

FOREIGN PATENT DOCUMENTS

| | | | |
|---|---|---|---|
| JP | 11-84874 | A | 3/1999 |
| JP | 2005-326487 | A | 11/2005 |
| JP | 2007-264511 | A | 10/2007 |
| JP | 2008-139585 | A | 6/2008 |

* cited by examiner

*Primary Examiner* — Hoang Ngo
(74) *Attorney, Agent, or Firm* — Canon USA Inc IP Division

(57) ABSTRACT

A developing apparatus is provided in which, with reference to a middle position in a developer conveyance direction, an average friction coefficient between an inner wall of the developing chamber and the developer, is smaller at an upstream side than at a downstream side in the developer conveyance direction.

7 Claims, 14 Drawing Sheets

DEVELOPING APPARATUS

BACKGROUND OF THE INVENTION

1. Field of the Invention

The present disclosure relates to a developing apparatus that develops an electrostatic latent image formed on an image carrier by an electro-photographic method or an electrostatic recording method, and particularly to a developing apparatus of a two-component developer type including toner and carrier.

2. Description of the Related Art

An image forming apparatus such as a copy machine using an electro-photographic method visualizes an image by applying toner to the electrostatic latent image formed on an image carrier such as a photosensitive drum. Such a conventional developing apparatus is known that uses two-component developer (hereinafter, referred to as "developer") including toner and carrier, and includes a first conveyance screw and a second conveyance screw that convey the developer as stirring it. The first conveyance screw provided in a developing chamber is used to supply the developer to a developing sleeve, which is a developer carrier. The second conveyance screw provided in a stirring chamber is used to mix and stir the developer collected from the developing sleeve and the developer newly supplied. Such first and second conveyance screws are paired and convey the developer in opposite directions each other to circulate the developer between the developing chamber and the stirring chamber.

The developer is unevenly distributed in the developer container of such a developing apparatus. The developing apparatus of a "vertical, stirring type" will be described herein as an example. The developer container in the developing apparatus includes the developing chamber and the stirring chamber, which are separated from each other. The developing chamber supplies the developer to the developing sleeve, and the stirring chamber collects and stirs the developer from the developing sleeve. The developing chamber and the stirring chamber are disposed in a vertical direction, and a part of the developer conveyed from the developing chamber to the stirring chamber passes through a connection portion for connecting the developing chamber and the stirring chamber, and moves downward or upward.

During circulation of the developer at this point, the whole developer sent from the stirring chamber to the developing chamber does not reach a downstream end of the first conveyance screw in the developing chamber but some developer is supplied to the developing sleeve on the way. Such developer is collected into the stirring chamber after the developer passes through a development region. The developer is sent to the developing sleeve almost over the whole region in a longitudinal direction of the developing sleeve. Therefore, in the developing chamber, an amount of the developer conveyed by the first conveyance screw tends to gradually decreases it flows from an upstream end to the downstream end.

On the other hand, in the stirring chamber, the amount of the developer conveyed by the second conveyance screw tends to gradually increase as it flows from the upstream end to the downstream end. In other words, the developer is unevenly distributed in the developing apparatus.

The developer is unevenly distributed in the developer container as described above, which may cause image defect such as a white spot and density unevenness. The white spot is a part of an image portion which is not developed due to lack of the developer at a downstream side in a conveyance direction (hereafter, referred to as a "downstream side") of the developing chamber for supplying the developer to the developing sleeve. The density unevenness is caused by insufficient supply of the developer.

Japanese Patent Application Laid-Open No 11-84874 discusses a configuration in which the uneven distribution of the developer is reduced by varying a conveyance capacity of the conveyance screws between an upstream side in a conveyance direction (hereafter, referred to as an "upstream side") and a downstream side therein, in other words, by raising the conveyance capacity at the upstream side compared with at the downstream side.

However, if images are continuously output at a low printing ratio, the developer decreases its flowability since the developing becomes deteriorated. Particularly, the flowability is decreased when the toner is badly deteriorated, for example, due to removal of external additives from the toner. Thus, a speed for conveying the developer becomes slower in the developer container compared with when it is not deteriorated.

On the other hand, the decrease amount of the developer decreased per unit of time as it flows from the upstream end to the downstream end in the developing chamber, in other words, the amount of the developer conveyed by the developing sleeve, does not vary between before and after the toner deterioration. Namely, the decrease amount of the developer remains substantially constant.

Therefore, even if the uneven distribution of the developer can be reduced in the developer container in an initial state, in which the developer is not yet deteriorated, when the developer is deteriorated and decreases its flowability, the uneven distribution of the developer cannot be sufficiently reduced. In other words, when the developer is further deteriorated and decreases its flowability, the decreased flowability causes the uneven distribution on a surface of the developer.

Therefore, at the downstream side in a developer conveyance direction in the developing chamber for supplying the developer to the developer carrier, the image defect such as the white spot and the density unevenness due to the lack of the developer may occur.

SUMMARY OF THE INVENTION

The present disclosure is directed to a developing apparatus capable of reducing uneven distribution of a surface of developer in a developer container caused by varied flowability of the developer.

According to an aspect of the present invention, a developing apparatus includes a developer carrier configured to carry developer including toner and carrier and develop an electrostatic latent image at a development position, a developer container, which is separated to be segmented into a developing chamber for supplying the developer to the developer carrier and a stirring chamber for collecting the developer to be stirred, from the developer carrier and in which a circulation path for circulating the developer in the developing chamber and the stirring chamber is formed, and a conveyance unit, provided in each of the developing chamber and the stirring chamber, configured to convey and circulate the developer in the developing chamber and the stirring chamber, wherein, an average surface roughness of inner walls of the developer container facing at least the development position in an axial direction of the developer carrier, is smaller in a second region at a side for turning over the developer from the stirring chamber to the developing chamber than in a first region at a side for turning over the developer from the developing chamber to the stirring chamber, with reference to a middle position of the development position in the axial direction of the developer carrier.

Further features and aspects will become apparent from the following detailed description of exemplary embodiments with reference to the attached drawings.

BRIEF DESCRIPTION OF THE DRAWING

The accompanying drawings, which are incorporated in and constitute a part of the specification, illustrate exemplary embodiments, features, and aspects of the disclosure and, together with the description, serve to explain the principles of the invention.

DESCRIPTION OF THE EMBODIMENT

Various exemplary embodiments, features, and aspects will be described in detail below with reference to the drawings.

Figure 1:
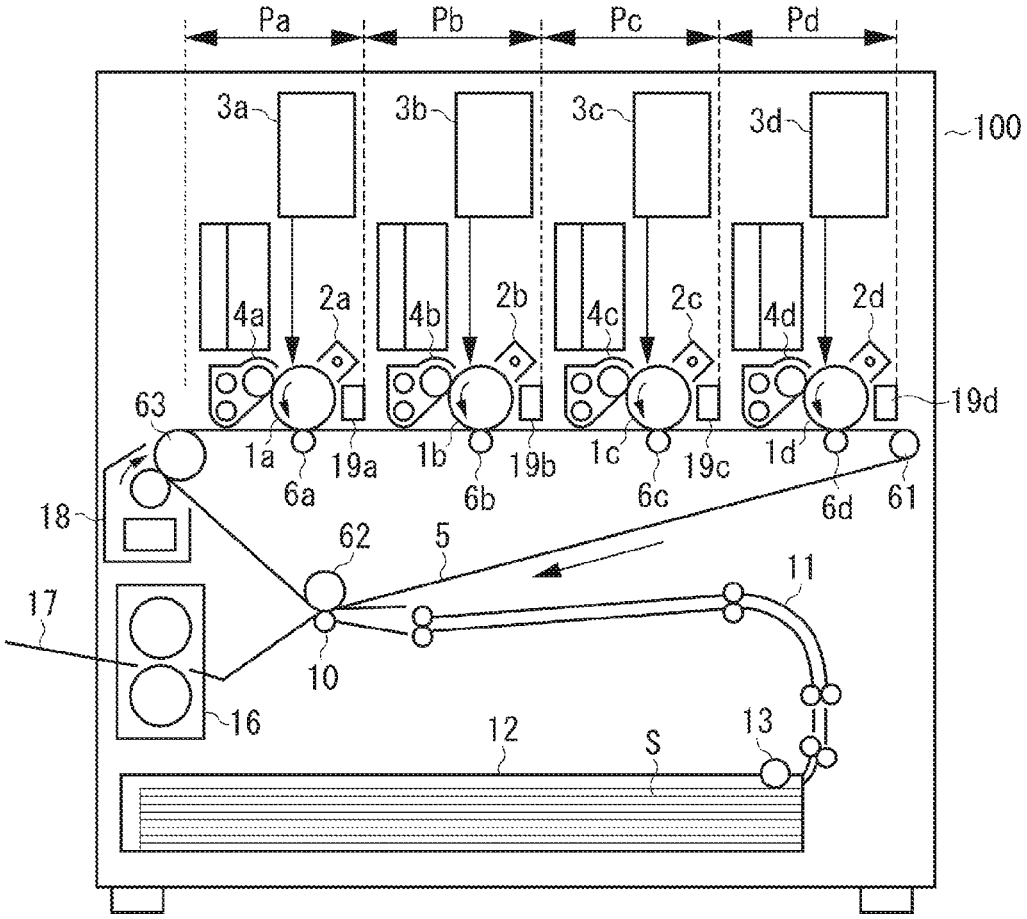
FIG. 1 illustrates a schematic configuration of an image forming apparatus according to a first exemplary embodiment.

FIG. 1 illustrates a schematic configuration of a color image forming apparatus 100 adopting an electro-photographic method, according to a first exemplary embodiment of an image forming apparatus to which the present disclosure can be applied.

According to the first exemplary embodiment, the image forming apparatus 100 includes four image forming units "P" (Pa, Pb, Pc, and Pd) forming four toner images in respective four colors of yellow, magenta, cyan, and black. The image forming units Pa, Pb, Pc, and Pd include an electro-photographic photosensitive drum in a drum shape rotating in an arrow direction (counterclockwise direction) serving as an image carrier, namely, the photosensitive drums 1 (1*a*, 1*b*, 1*c*, and 1*d*). In the periphery of the photosensitive drums 1, image forming devices including charging units 2 (2*a*, 2*b*, 2*c*, and 2*d*), laser beam scanners 3 (3*a*, 3*b*, 3*c*, and 3*d*) serving as exposure units disposed at upper positions of the photosensitive drum 1 illustrated in FIG. 1, developing devices 4 (4*a*, 4*b*, 4*c*, and 4*d*), transfer rollers 6 (6*a*, 6*b*, 6*c*, and 6*d*) and cleaning devices 19 (19*a*, 19*b*, 19*c*, and 19*d*) are provided.

The image forming units Pa, Pb, Pc, and Pd are similarly constructed, and the photosensitive drums 1*a*, 1*b*, 1*c*, and 1*d* disposed therein are also similarly constructed. Therefore, for example, the photosensitive drums 1*a*, 1*b*, 1*c*, and 1*d* are collectively referred to as the "photosensitive drum 1". Similarly, the image forming devices including the charging units 2*a*, 2*b*, 2*c*, and 2*d*, the laser beam scanners 3*a*, 3*b*, 3*c*, and 3*d*, the developing devices 4*a*, 4*b*, 4*c*, and 4*d*, the transfer rollers 6*a*, 6*b*, 6*c*, and 6*d*, and the cleaning devices 19*a*, 19*b*, 19*c*, and 19*d* disposed in the respective image forming units Pa, Pb, Pc, and Pd are similarly constructed therein, and thus they are collectively referred to as the charging unit 2, the laser beam scanner 3, the developing device 4, the transfer roller 6, and the cleaning device 19.

An image forming operation of the overall image forming apparatus 100 having the above-described configuration will be described.

First, the photosensitive drum 1 is uniformly charged by a charging unit 2. The photosensitive drum 1 is rotated at a process speed (circumferential speed) of 273 mm/sec in the counterclockwise direction as indicated with arrows.

Scanning exposure is performed on the uniformly charged photosensitive drum 1 by the above-described laser beam scanner 3 with a laser beam modulated with an image signal. The laser beam scanner 3, which is an exposure unit, includes a built-in semiconductor laser, which is controlled corresponding to an image information signal output by a document reading device including a photoelectric conversion element such as charge-coupled device (CCD), and outputs the laser beam. With this arrangement, the charged photosensitive drum 1 is exposed to form the electrostatic latent image on the photosensitive drum 1. This electrostatic latent image is developed by the developing device 4 to form a visible image, in other words, a toner image.

According to the exemplary embodiment, the developing device 4 uses a two-component contact developer method in which the two-component developer (hereafter, referred to as "developer") including the toner and the carrier is used as the developer and development is performed by bringing the photosensitive drum into contact with the developer carried in a magnetic brush shape. However an effect of the present invention can be also acquired by the two-component non-contact developer method.

According to the exemplary embodiment, at a lower positions of the image forming units Pa, Pb, Pc, and Pd, an intermediate transfer belt 5, which is an intermediate transfer member, is disposed. The intermediate transfer belt 5 is held by rollers 61, 62, and 63, and can be moved in an arrow direction. The above-described image forming operations are performed for each of the image forming units Pa, Pb, Pc, and Pd to form the toner images in four colors of yellow, magenta, cyan, and black on each of the photosensitive drums 1*a*, 1*b*, 1*c*, and 1*d*. The toner images formed on the above-described photosensitive drum 1 are transferred onto the intermediate transfer belt 5 by the transfer roller 6, which is a first transfer unit. With this arrangement, on the intermediate transfer belt 5, the toner images in four colors of yellow, magenta, cyan, and black are superimposed to form a full-color toner image. Further, the remaining toner that has not been transferred from on the photosensitive drum 1 onto the transfer member and remains on the drum is collected by the cleaning device 19.

A secondary transfer roller 10, which is a second transfer unit, transfers the full-color image on the intermediate transfer belt 5 onto the transfer member such as paper removed from a paper feeding cassette 12 and conveyed via a paper feeding roller 13 and a paper feeding guide 11. The remaining toner that has not been transferred and remains on a surface of the intermediate transfer belt 5 is collected by an intermediate transfer belt cleaning device 18. Subsequently, the transfer member on which the full-color toner image is transferred is transmitted to a fixing device 16 (thermal roller fixing device), and the toner image on the transfer member is fixed to form a fixed image and then discharged to a sheet discharge tray 17.

According to the present exemplary embodiment, as the image carrier, the photosensitive drum 1 that is an organic photosensitive member in a drum shape is used. However, an inorganic photosensitive member such as an amorphous silicon photosensitive member or a photosensitive member in a belt shape may also be used.

Figure 2:
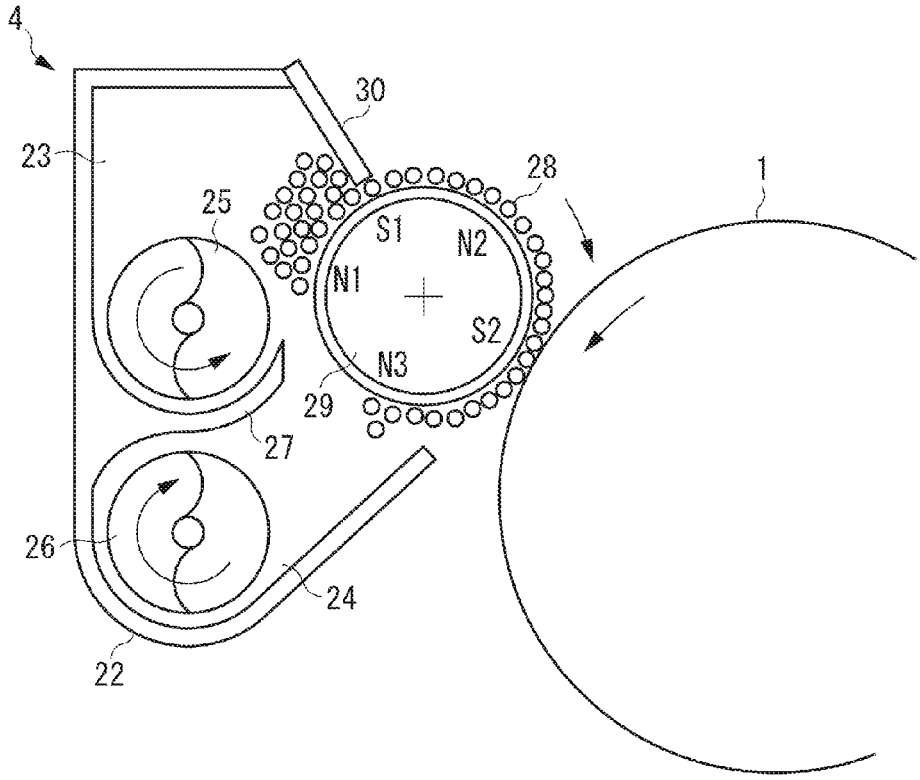
FIG. 2 is a vertical cross-sectional view in a longitudinal direction of a developing apparatus according to the first exemplary embodiment.
Figure 3:
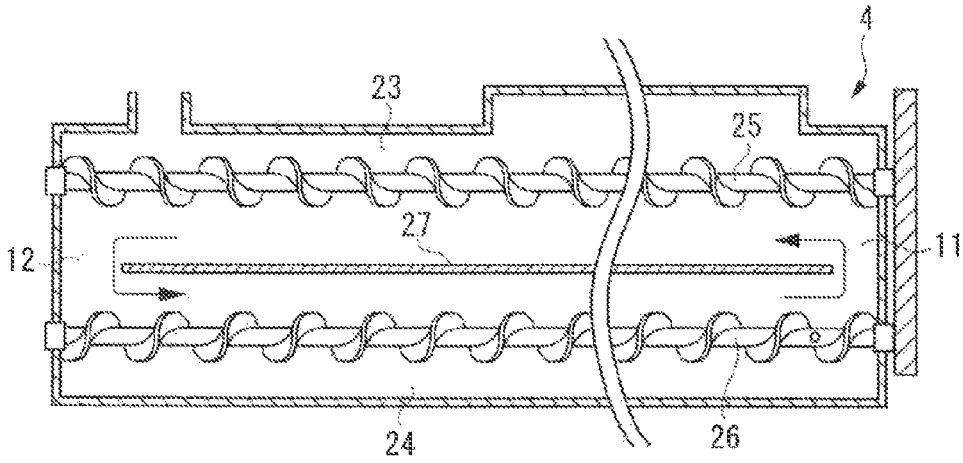
FIG. 3 is a cross-sectional view in the longitudinal direction of the developing apparatus according to the first exemplary embodiment.

A configuration of the developing device 4 according to the present exemplary embodiment will be described. FIGS. 2 and 3 illustrate cross sectional view of the developing device 4 according to the present exemplary embodiment. The developing device 4 includes a developer container 22, which stores the developer including the toner and the carrier in the developer container 22. Further, in the developer container 22, the developing device 4 includes a developing sleeve 28, which is the developer carrier, and the restriction blade 30 for restricting ears of the developer carried in a magnetic brush shape on the developing sleeve 28. An opening portion is disposed at a position corresponding to the development region facing the photosensitive drum 1 of the developer container 22. At the opening portion, the developing sleeve 28, which is the developer carrier, is rotatably disposed so as to be partly exposed in a direction of the photosensitive drum. The developing sleeve 28 is made of non-magnetic material such as aluminum and stainless, and a magnet roller 29, which is a magnetic field unit, is non-rotatably disposed in the developing sleeve 28.

In the developing device 4, the developer container 22 is separated into a developing chamber 23 and a stirring chamber 24 in a perpendicular direction by a partition wall 27 extended in a vertical direction of a surface of paper, and the developer is stored in the developing chamber 23 and the stirring chamber 24. The developing apparatus is a vertical, stirring type, in which the developing chamber 23 supplies the developer to the developing sleeve 28, and the stirring chamber 24 collects and stirs the developer that has passed the development region from the developing sleeve 28 and has not been used. The developing chamber 23 and the stirring chamber 24 are provided with the first conveyance screw 25 and the second conveyance screw 26 as a developer conveyance unit.

The first conveyance screw 25 is disposed at a bottom portion in the developing chamber 23 substantially parallel along an axial direction of the developing sleeve 28, and is rotated to convey the developer in the developing chamber 23 in one direction along the axial direction. The second conveyance screw 26 is disposed on a bottom portion in the stirring chamber 24 substantially parallel to the first conveyance screw 25, and is rotated to convey the developer in the stirring chamber 24 in a direction opposite to the first conveyance screw 25.

As described above, the developer is conveyed by the first conveyance screw 25 and the second conveyance screw 26 and circulated in the developing chamber 23 and the stirring chamber 24, passing through the connection portions 11 and 12, which are opening portions of both ends of the partition wall 27.

The developing sleeve 28 is rotated in an arrow direction (clockwise direction) indicated in FIG. 2 during the development to convey the developer. Layer thickness of the developer is restricted by cutting the ears with a restriction blade 30. The developer is conveyed to the development region facing the photosensitive drum 1, and supplied to the electrostatic latent image formed on the photosensitive drum 1, to develop the electrostatic latent image.

At this point, to improve development efficiency, in other words, an adherence ratio of the toner to the electrostatic latent image, development bias voltage acquired by superimposing direct current voltage on alternate current voltage is applied from a power source to the developing sleeve 28. However, a method for applying the voltage is not limited to the method described above, and the direct current voltage may be applied as the development bias voltage.

The developing sleeve 28 is rotated in a forward direction of a rotation of the photosensitive drum 1 in the development region at a circumferential speed ratio of 1.75 times relative to the photosensitive drum. This circumferential speed ratio is usually set between 0 to 3.0 times. The larger the moving speed ratio is, the more the development efficiency is increased. However, if it is set too large, the toner may be dispersed or the developer may be deteriorated, and thus it is preferable that the moving speed ratio be set within the above-described range.

The restriction blade 30, which is the ear cutting member, includes the member 30 formed of aluminum in a plate shape extended and provided along the axis line of the developing sleeve 28 in the longitudinal direction. The restriction blade 30 is disposed at the upstream side than the development region in a rotation direction of the developing sleeve. The developer carried by the developing sleeve 28 in the magnetic brush shape passes between an end portion of the restriction blade 30 and the developing sleeve 28, and is conveyed to the development region.

The developing device 4 of a vertical, stirring type including the developing chamber 23 and the stirring chamber 24 will be described in detail. In the developer container, the developing chamber 23 and the stirring chamber 24 are disposed in the vertical direction, and the developer is conveyed downwardly from the developing chamber 23 to the stirring chamber 24 via the connecting portion 12, and also conveyed upwardly from the stirring chamber 24 to the developing chamber 23 via the connection portion 11. Particularly, from the stirring chamber 24 to the developing chamber 23, the developer is conveyed, forced upwardly with pressure of the developer which is accumulated in an end portion of the stirring chamber 24.

At this point, the whole developer forced upwardly from the stirring chamber 24 to the developing chamber 23 does not reach the downstream end of the first conveyance screw 25 in the developing chamber 23, but a part of the developer is supplied to the developing sleeve 28 on the way, and collected by the stirring chamber 24 after the developer passes through a development region. In other words, the developer is turned over from the developing chamber 23 to the stirring chamber 24 via the developing sleeve 28.

The developer is turned over via the developing sleeve 28 over the substantially whole region thereof in a longitudinal direction of the developing sleeve 28. Therefore, in the developing chamber 23, an amount of the developer conveyed by the first conveyance screw 25 tends to be gradually decreased as it flows from an upstream end to the downstream end. On the other hand, in the stirring chamber 24, the amount of the developer conveyed by the second conveyance screw 26 tends to be gradually increased as it flows from the upstream end to the downstream end.

As described above, the developer is unevenly distributed in the developing chamber 23. In this case, if the developer is unevenly distributed too much, the developer may be insufficiently supplied at the downstream side in the developer conveyance direction, or may not be constantly supplied to the developing sleeve 28. Thus, image defect may be caused such as the white spot where a part of the image corresponding to a development position of the developing sleeve 28 at the downstream side in the developer conveyance direction drops off, or the density unevenness in the longitudinal direction of the axis of the developing sleeve 28.

To address the problems described above, according to the present exemplary embodiment, the following configuration is adopted to reduce the uneven distribution of the developer. A friction coefficient between an inner wall of the developer container and the developer is differentiated depending on the developer conveyance direction to solve the above-described problems. More specifically, the friction coefficient between the inner wall of the developing chamber and the developer is set smaller at the upstream side than at the downstream side with reference to a middle position in the developer conveyance direction. Further, the friction coefficient between the inner wall of the stirring chamber and the developer is set smaller at the downstream side than at the upstream side in the developer conveyance direction.

To reduce the uneven distribution of the developer in the developing chamber herein, the friction coefficient at least between the inner wall of the developing chamber and the developer may be set smaller at the upstream side than at the downstream side in the developer conveyance direction. Further, the friction coefficient between the inner wall of the stirring chamber and the developer is set smaller at the downstream side than at the upstream side with reference to the middle position in the developer conveyance direction. Thus, the uneven distribution of the developer in the stirring chamber is reduced. In addition, a function for stirring the tonner and the carrier can be improved in the stirring chamber, which is preferable. A region in which the friction coefficient of the inner wall of the developer container is varied is located at least within a region facing the development region with respect to the axial direction of the developing sleeve. With this arrangement, tilt of a height of the developer surface in a region for supplying the developer to the developing sleeve can be reduced.

What influence the friction coefficient of the inner wall of the developer container gives to the amount of the developer will be described below.

Figure 4:
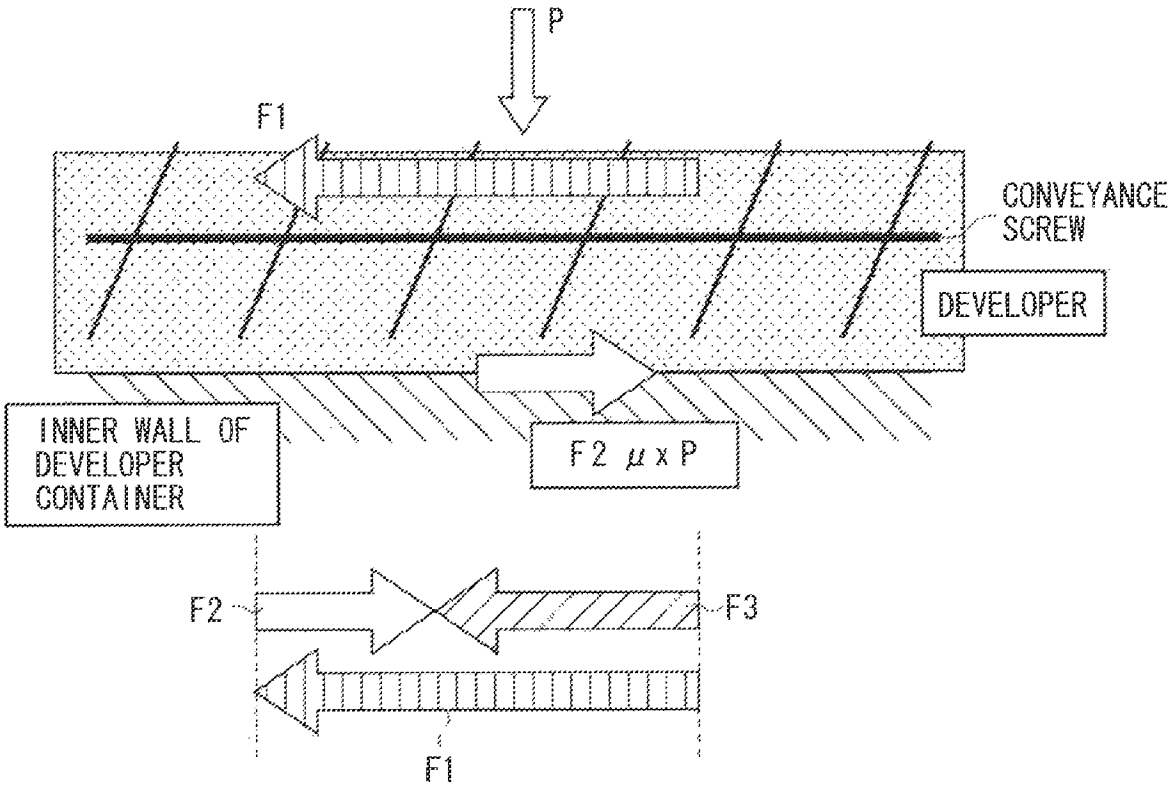
FIG. 4 illustrates friction forces received from an inner wall while developer is being conveyed in a developer container.

FIG. 4 illustrates a model of the friction force received from the inner wall while the developer in the developer container is being conveyed. It is assumed herein that a uniform force F1 is applied to the developer by a conveyance force of the conveyance screw. Between the inner wall of the developer container and the developer, a force F2 is applied in proportion to a dynamic friction coefficient "μ" (hereafter, referred to as a "friction coefficient "μ"") between a vertical weight and a surface of the inner wall as a resistance in an opposite direction of the force F1. More specifically, a difference F3 between the force F1 and the force F2 is ultimately generated as the force to be applied to the developer to convey the developer.

The larger the friction coefficient "μ" between the developer and the wall surface of the developer container is, the larger the force F2 is, and thus the speed for conveying the developer becomes slower. In a region where the speed for conveying the developer is relatively slower than in other regions, the less developer flows out than the developer which flows in, and the amount of the developer staying in a certain section per unit of time is increased. Therefore, in the region where the speed for conveying the developer is relatively slower than in other regions, the amount of the developer is increased. On the other hand, in the region where the speed for conveying the developer is relatively higher than in other regions, more developer flows out than the developer which flows in, and thus the amount of the developer is decreased. Therefore, the conveyance speed of the developer is varied between the upstream side and the downstream side in the conveyance direction, so that the uneven distribution of the developer can be reduced.

According to the present exemplary embodiment, the friction coefficient "μ" of the inner wall is differentiated for each region of the developer container in the conveyance direction to increase or decrease the speed for conveying the developer, so that the uneven distribution of the developer can be reduced.

More specifically, according to the present exemplary embodiment, the friction coefficient "μ" of the inner wall is differentiated for each region of the developer container to differentiate the force F2 for each region to increase or decrease the speed for conveying the developer, so that the uneven distribution of the developer in the initial state where the developer is not deteriorated can be reduced. In addition, even when the developer is deteriorated and its flowablity is decreased, the uneven distribution of the developer caused by the decreased flowablity can be reduced. The details will be described below.

First, the conveyance force F1 of the conveyance screw in the developing apparatus scarcely varies, whether the developer is in an initial state or deteriorated, unless the number of rotations of the conveyance screw is changed. The amount of the developer moving from the developing chamber 23 to the stirring chamber 24 via the developing sleeve scarcely varies either, unless the number of rotations of the developing sleeve and the conveyance force thereof are changed.

Generally, it is known that the flowability of the deteriorated developer is decreased compared with that of the developer in the initial state because the external additive of the toner in the deteriorated developer comes off. One cause of decreasing of the flowablity is that energy is greatly lost due to the friction between the developer and the developer and between the developer and the developer container. Therefore, the speed for conveying the deteriorated developer in the developing chamber 23 and the stirring chamber 24 becomes slower than the developer in the initial state, and thus the deteriorated developer is more unevenly distributed than the developer in the initial state.

If the conveyance force of the conveyance screw is differentiated between the upstream side and the downstream side in the conveyance direction, the uneven distribution of the developer in the initial state can be reduced. However, even in such a configuration, if the developer is deteriorated, a relative amount of the developer to be conveyed to the stirring chamber via the developing sleeve is increased due to the decreased flowability. Therefore, the more amount of the developer is necessary at the downstream side of the developing chamber in the conveyance direction and the upstream side of the stirring chamber when the developer is deteriorated than when the developer is in the initial state.

Figure 5A:
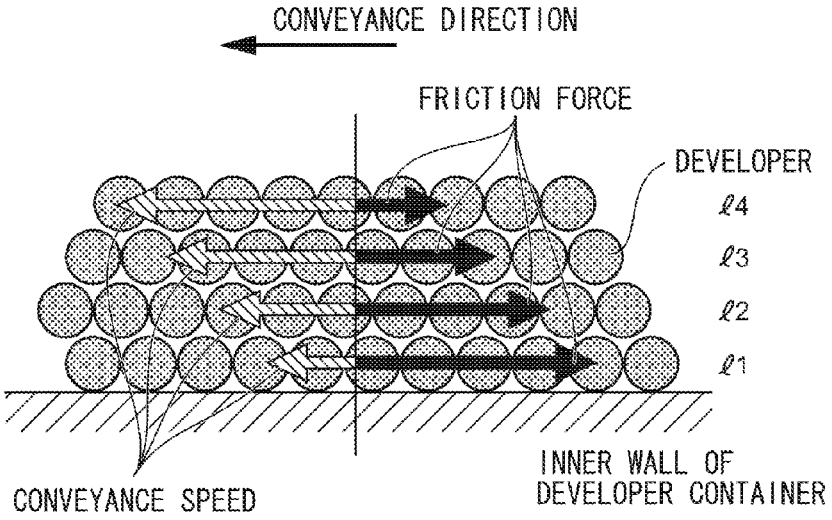
FIG. 5A illustrates friction forces on a wall surface of the developer container that initial developer receives.
Figure 5B:
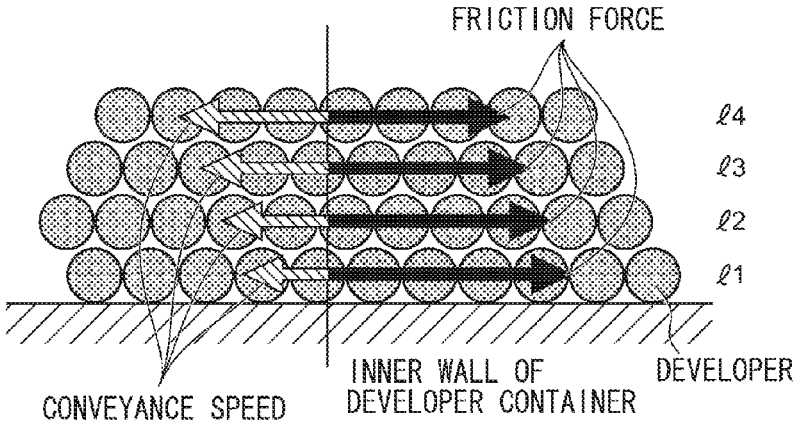
FIG. 5B illustrates friction forces on the wall surface of the developer container that deteriorated developer receives.

FIGS. 5A and 5B are schematic diagrams illustrating friction forces transmitting through the developer. FIG. 5A illustrates the developer in the initial state located near the inner wall in the developer container. FIG. 5B illustrates the deteriorated developer located near the inner wall in the developer container. Developer L1 indicates the developer of a first layer that is directly in contact with the inner wall of the developer container, and subsequently developer L2, L3 and more follow. The developer in the initial state loses less energy since the flowability is higher and the friction force between the developer and the developer is small. Accordingly, the force caused by the friction that the developer L1 receives from the inner wall is transmitted to the developer L2 and L3 as it becomes weaker.

On the other hand, the deteriorated developer has the lower flowability, and thus the friction force between the developer and the developer is large. Accordingly, the friction force that the developer L1 receives from the inner wall is transmitted to the developer L2 and L3 without becoming much weaker. More specifically, the friction coefficient "μ" between the surface of the inner wall of the developer container and the developer influences the speed for conveying the developer more when the developer is deteriorated than when it is in the initial state.

The speed for conveying the deteriorated developer is slower due to the decreasing of the flowability than that of the developer in the initial state. Thus, it takes longer time for the deteriorated developer to be conveyed from the upstream end to the downstream end in the developing chamber 23. However, the amount of the developer conveyed per unit of time from the developing chamber 23 to the stirring chamber 24 by the developing sleeve 28 is not different between the developer in the initial state and the deteriorated developer. More specifically, the amount of the deteriorated developer conveyed by the developing sleeve 28 is relatively larger than that conveyed by the conveyance screw in the developing chamber 23.

Therefore, in the developing chamber 23, the amount of the deteriorated developer conveyed to the stirring chamber 24 in a given section is relatively larger than that of the developer in the initial state, thereby causing the uneven distribution of the developer. Further, similarly in the stirring chamber 24, the amount of the deteriorated developer conveyed to the stirring chamber 24 in a given section is relatively larger than that of the developer in the initial state, thereby causing the uneven distribution of the developer.

According to the present exemplary embodiment, the friction coefficient "μ" between the inner wall of the developer container and the developer is varied for each region in the conveyance direction. The influence which the friction coefficient "μ" between the developer and the surface of the inner wall gives to the speed for conveying the developer is different between the developer in the initial state and the deteriorated developer. Therefore, a region having the low friction coefficient "μ" between the developer and the surface of the inner wall and a region having the high friction coefficient "μ" therebetween are formed to reduce the uneven distribution of the developer caused by the decreased flowability.

The developer located near the inner wall of the developer container receives the friction force from the surface of the inner wall, and the developer located away from the inner wall receives the friction force from the developer surrounding it. The deteriorated developer loses more energy due to the friction between the developer and the inner wall of the developer container and between the developer and the developer.

Therefore, when the developer is deteriorated and its flowability decreases, the developer being conveyed receives the more influence of the friction force. Particularly, when the flowability of the developer is decreased, in the region having the higher friction coefficient "μ", the relatively larger influence of the friction force is given to the developer being conveyed than in the region having the lower friction coefficient "μ". Therefore, the conveyance speed of the developer in the region having the higher friction coefficient "μ" is relatively slower than in the region having the lower friction coefficient "μ" corresponding to the decreased flowability.

Thus, an average value of the friction coefficients between the inner wall of the developing chamber and the developer is set smaller at the upstream side than that at the downstream side in the developer conveyance direction. Thus, regardless of the flowability of the developer, in other words, regardless whether the developer is in the initial state or deteriorated, the image defect such as the white spot and the density unevenness can be prevented.

Figure 6:
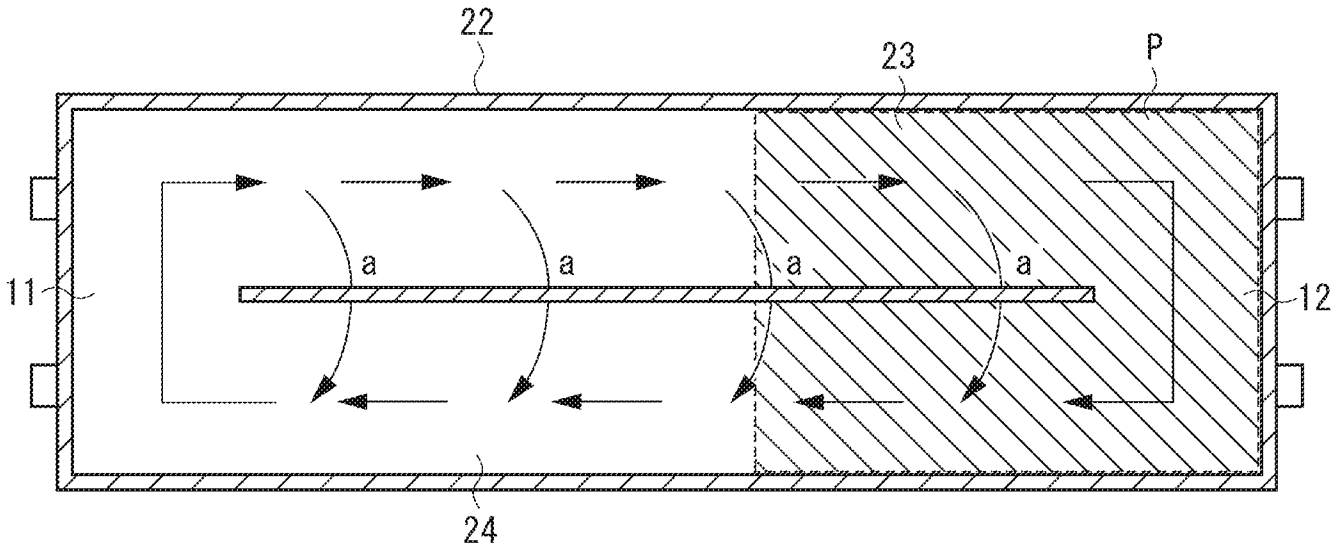
FIG. 6 illustrates a friction coefficient on the inner wall of the developing apparatus according to the first exemplary embodiment.

A configuration of the inner wall of the developer container, which is the characteristic of the present exemplary embodiment, will be described in detail below with reference to FIG. 6. FIG. 6 illustrates the friction coefficients of the inner wall of the developer container according to the present exemplary embodiment.

As illustrated in FIG. 6, in the developer container 22, the friction coefficient "μ" of the inner wall of a shaded region "P" is set larger than those of other regions. According to the present exemplary embodiment, the friction coefficient "μ" is set large by increasing an arithmetic average roughness Ra of the inner wall of the shaded region "P". In the shaded region "P", pearskin finish is performed to set the arithmetic average roughness Ra to 2.2 μm, which is larger by 1.0 μm than in other regions, so that the friction coefficient with the developer is set larger than in the other regions.

According to the present exemplary embodiment, the friction coefficient with the developer in the shaded region "P" is 0.84, and the friction coefficient with the developer in the other regions is 0.58. The friction coefficient in the shaded region "P" according to the present exemplary embodiment is about 1.45 times as large as that in the other regions, however, considering the uneven distribution of the developer and the flowability, 1.3 to 2.0 times is preferable. The coefficient is not limited to the values described above, and effects of the present invention can be acquired as long as the friction coefficient in the shaded region "P" is increased compared with that in the other regions.

Figure 7:
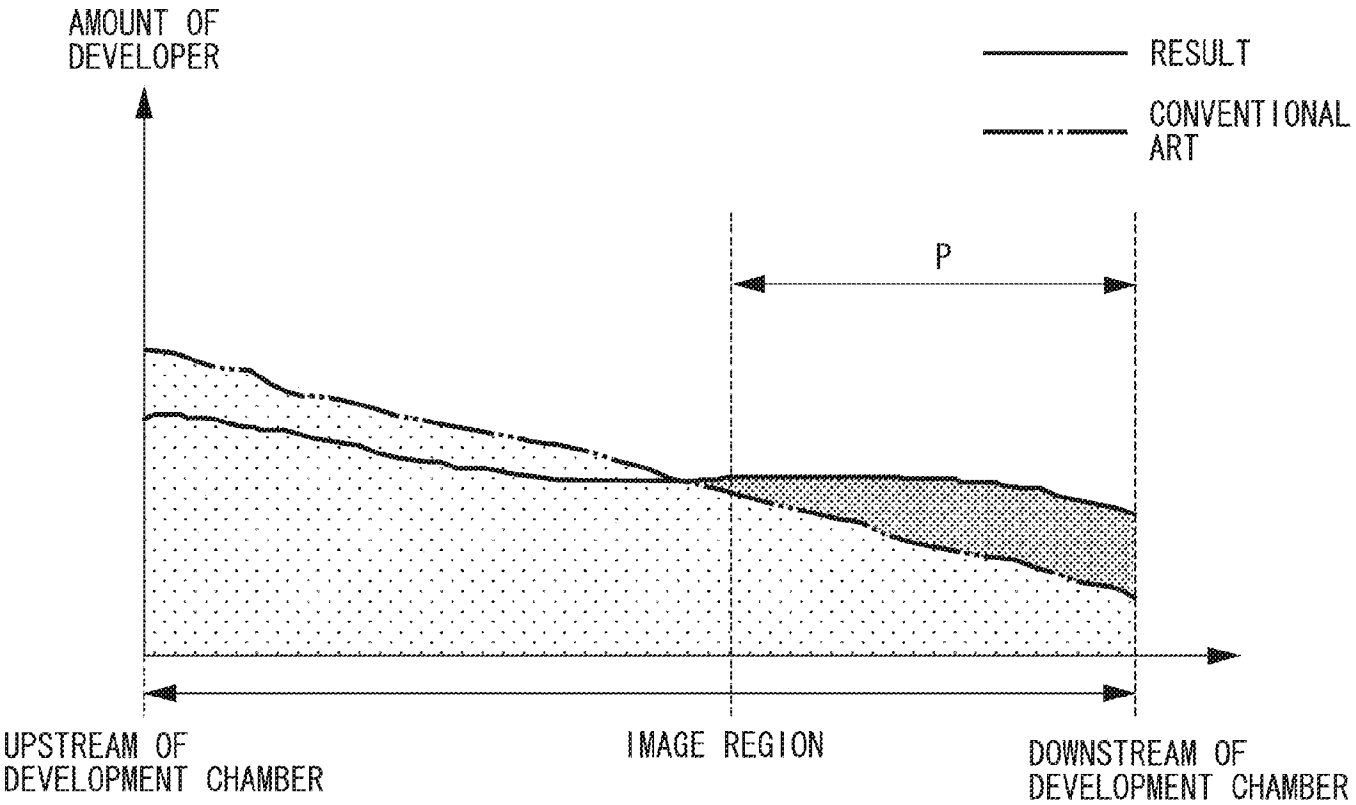
FIG. 7 illustrates an experimental result in which the developing apparatus according to the first exemplary embodiment is compared with a conventional developing apparatus.

FIG. 7 illustrates a result in which the amounts of the developer (heights of the surface of the developer) per unit area in the developing chamber in the developer conveyance direction are compared between the developing apparatus according to the present exemplary embodiment illustrated in FIG. 6 and the conventional developing apparatus in which the friction coefficients are uniform in the developer container. Other than the friction coefficient in the developer container, regarding the configuration of the developing apparatus, the developer, and the rotation speeds of the first and second screws and the developing sleeve, for example, the same experimental conditions are adopted between the developing apparatus according to the present exemplary embodiment and the conventional developing apparatus.

With reference to FIG. 7, according to the present exemplary embodiment, over the entire region of the developing chamber 23 and the stirring chamber 24, the uneven distribution of the developer is reduced, so that the effects of the present invention are achieved. FIG. 7 illustrates the result in which the uneven distribution of the developer in the developing chamber 23 is reduced, and the similar result can be also acquired in the stirring chamber 24.

Reasons why the friction coefficients are averaged will be described herein. For example, in a certain measurement position in the developing chamber 23, even when a region has the larger friction coefficient "μ" at the upstream side than at the downstream side, if the average value of the friction coefficients "μ" at the entire region of downstream side is larger than at the upstream side, a local effect is diminished, so that the effects of the present invention can be achieved.

On the other hand, even when only at a certain measurement position in the developing chamber 23, the region has the larger friction coefficient "μ" at the downstream side than the upstream side, if the average value of the friction coefficients "μ" at the entire region of the upstream side is larger than at the downstream side, similarly the local effect is diminished, and the effects of the present invention may not be acquired. Thus, it is preferable that the friction coefficients "μ" at the upstream side and the downstream side be specified with respective average values.

Terms of the "upstream side" and the "downstream side" referred to herein are commonly used for the developing chamber 23 and the stirring chamber 24, and refer to sections separated into an upstream portion and a downstream portion in the conveyance direction having a boundary at a center position of the image region in the developing apparatus in the longitudinal direction. Since the developer is conveyed by the developing sleeve, the developer is distributed unevenly both in the developing chamber and the stirring chamber.

Figure 8:
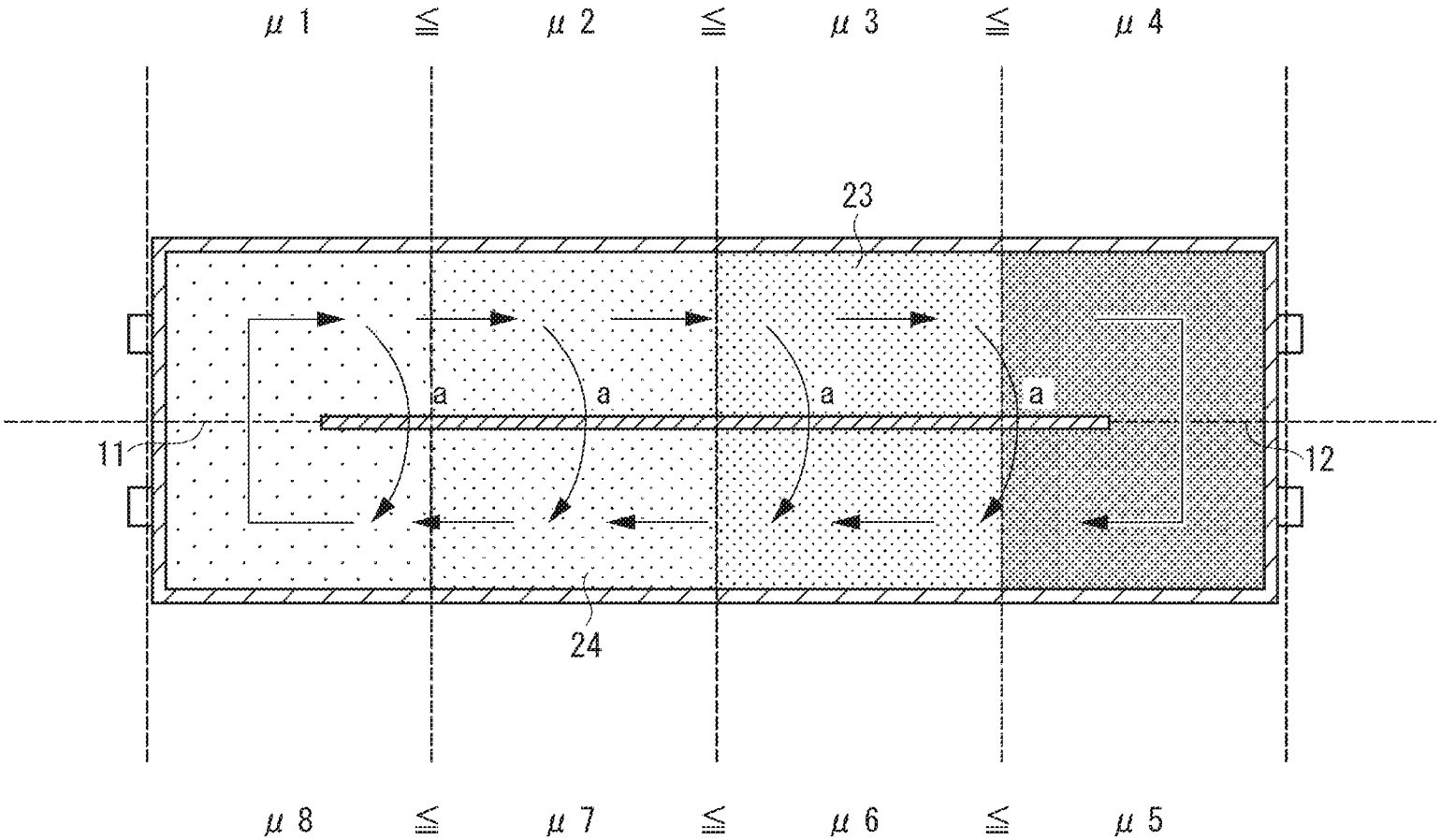
FIG. 8 indicates friction coefficients "μ" of the developing apparatus according to the first exemplary embodiment.

Even when the friction coefficients "μ" are distributed as illustrated in FIG. 8, the effects of the present invention can be also acquired. In other words, as illustrated in FIG. 8, the developer container may be separated into a plurality of regions. In the developing chamber 23, the friction coefficient "μ" between the developer and the inner wall may be increased step by step from the upstream portion to the downstream portion in the developer conveyance direction. Further, in the stirring chamber 24, the friction coefficient "μ" with the inner wall may be decreased step by step from the upstream portion to the downstream portion.

Figure 9:
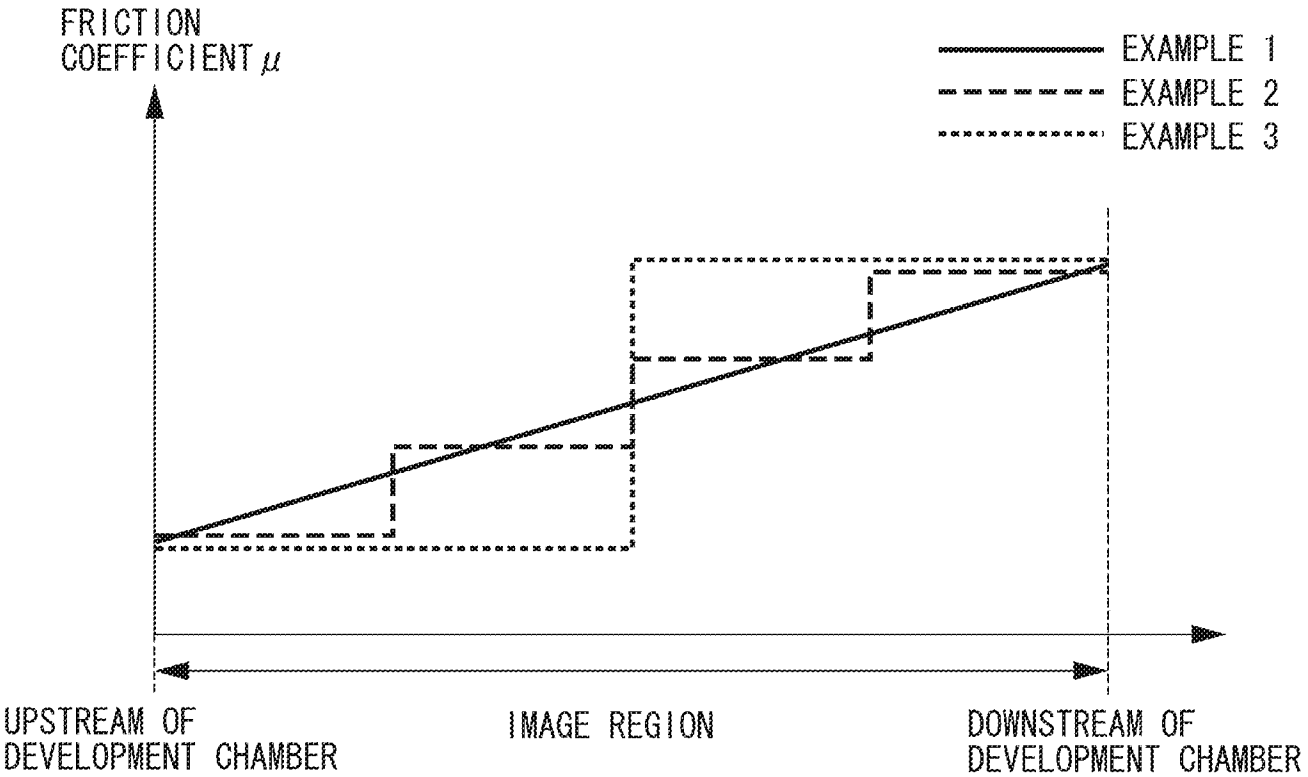
FIG. 9 illustrates the friction coefficients "μ" of the developing apparatus according to the first exemplary embodiment.

Further, in the developing chamber, the friction coefficient may be distributed as indicated with Examples 1, 2, and 3 as illustrated in FIG. 9. More specifically, as indicated in Example 3, the friction coefficients may be differentiated substantially across a middle point in the conveyance direction as illustrated in FIG. 6, and as indicated in Example 2, the developing chamber may be separated to be segmented into four parts in the conveyance direction to have the different friction coefficients in four stages as illustrated in FIG. 8 to acquire the effects of the present invention. Further, as indicated in Example 1, the friction coefficient may be simply increased from the upstream portion to the downstream portion in the developer conveyance direction to acquire the effect of the present invention.

Figure 10:
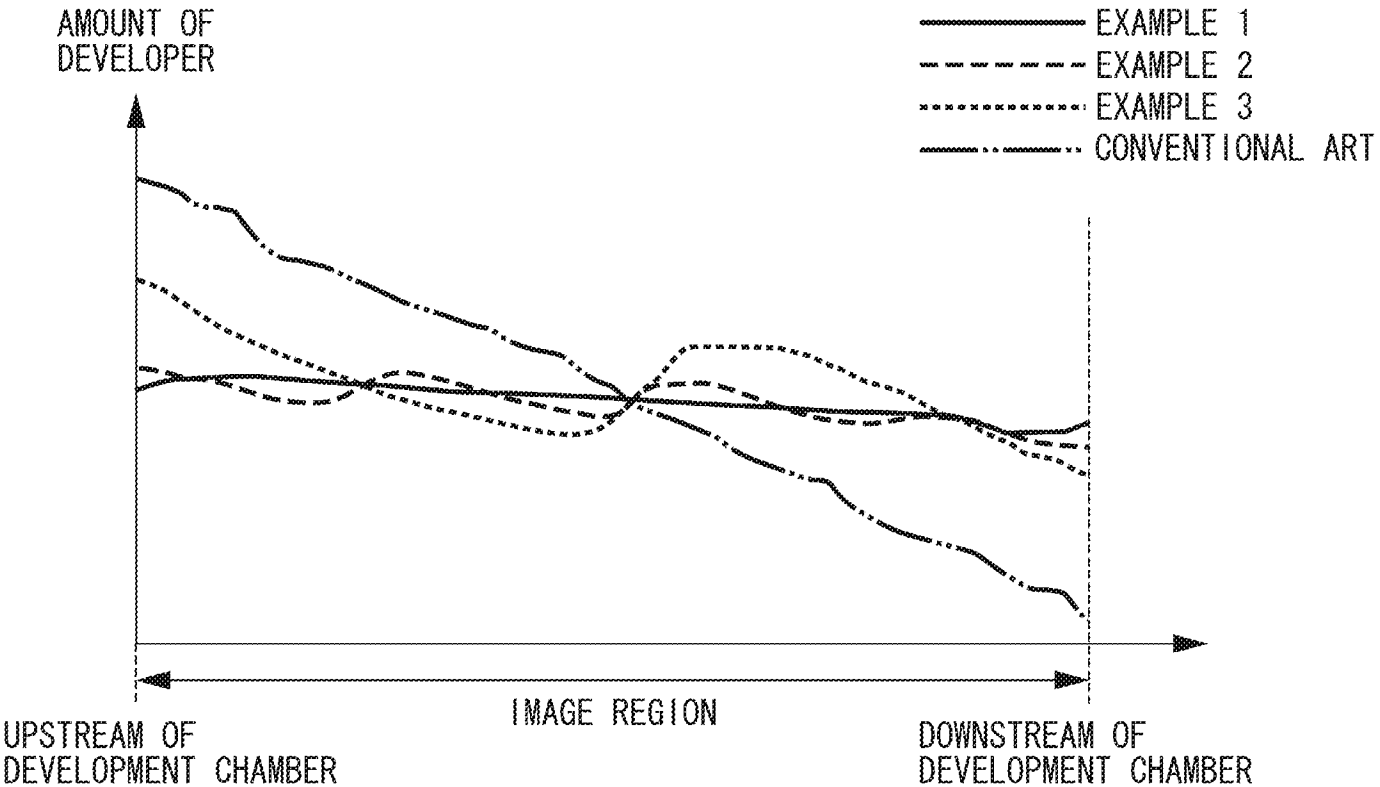
FIG. 10 illustrates comparison of experimental results depending on difference in the friction coefficients "μ".

FIG. 10 illustrates experimental results indicating surfaces of the deteriorated developer at a developing chamber side indicated in Examples 1, 2, and 3 described above. The friction coefficient of the inner wall of the conventional developer container is constant, and the conveyance force of the screw is differentiated between the upstream portion and the downstream portion in the conveyance direction. The friction coefficients of the inner walls of the developer container indicated in Examples 1, 2, and 3 illustrated in FIG. 9 are differentiated between the upstream side and the downstream side in the conveyance direction.

FIG. 10 illustrates the uneven distribution of the surfaces of the deteriorated developer for the conventional developer container and Example 1, 2, and 3. If the developer is in the initial state, the uneven distribution of the developer scarcely occurs in the conventional developer container and Example 1, 2, and 3. Subsequently, the conveyance screw and the developing sleeve in the developer container were driven for a predetermined time to deteriorate the developer, and then the height of the surface of the developer in the developing chamber was measured.

As seen from FIG. 10, the uneven distribution of the developer is reduced in order of Example 1, Example 2, and Example 3. Namely, the uneven distribution is more reduced in Example 2 than in Example 3, and the uneven distribution is more reduced in Example 1 than in Example 2. If difference of the average values of the arithmetic average roughness Ra of the inner walls of the developer container at the upstream portion and the downstream portion in the conveyance direction is Ra≤0.5 μm, the effect is small. It is preferably Ra≥1.0 μm.

A method for increasing the value of Ra is not limited to the pearskin finish, and a method for changing the surface roughness, such as sandblasting and surface texturing, may be used. The arithmetic average roughness Ra referred to in the present invention is a value specifying the arithmetic average roughness described by JIS-B0601 and ISO468 and can be acquired by the following equation. However, in the present exemplary embodiment, the roughness is not limited to the arithmetic average roughness Ra, and it may be specified by the average roughness of the roughness at ten points.

$$R_a = \frac{1}{\ell}\int_0^{\ell} |f(x)|\,dx$$

Figure 11:
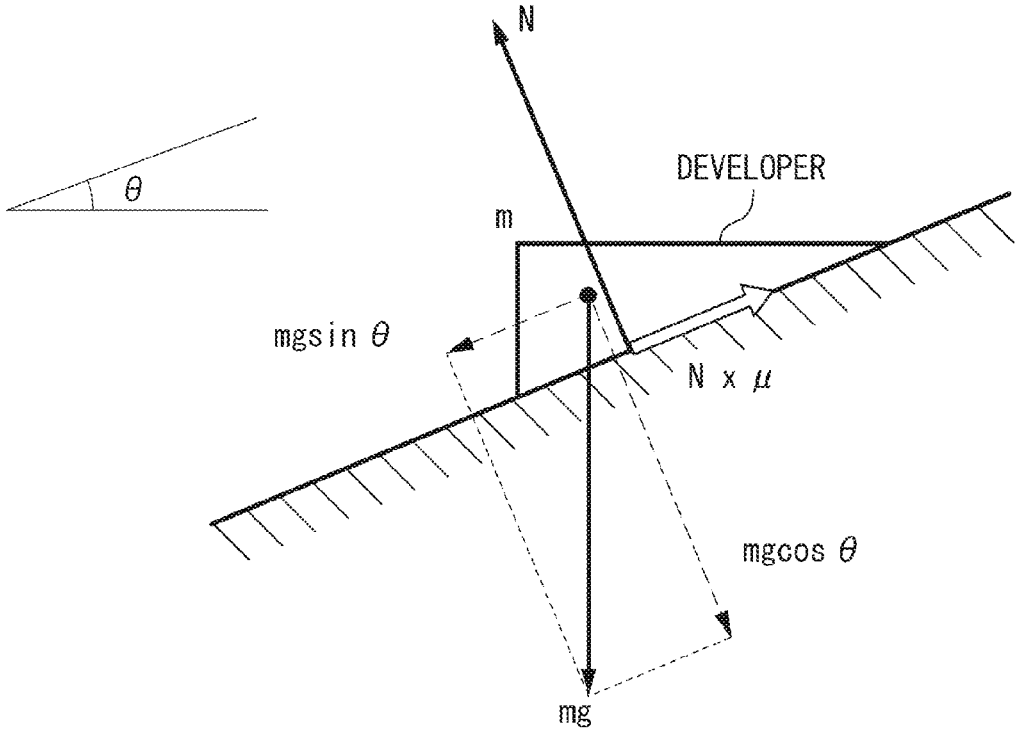
FIG. 11 illustrates relationship between the friction coefficient "μ" and a wall surface friction angle θf.

Ra is acquired by integrating an absolute value of the difference from a roughness curve f (x) to a center line (m) as illustrated in FIG. 11, and the acquired area is divided by a length, and the divided value is expressed in micro meter (μm). With respect to Ra, influence of a large difference in a shape of a surface on the measurement value becomes very small, so that a stable result is acquired.

To measure the surface roughness, a contact surface roughness measuring instrument (produced by Kosaka Labolatory Ltd., a surf corder SE-3400) was used. Conditions for the measurement were as follows. A cut-off value was 0.25 mm, a measured length was 2.5 mm, a forwarding speed was 0.1 mm/sec, and magnification was 2,000-fold. This measurement result was acquired from an average of measured values at five points near a region to be measured.

Figure 12:
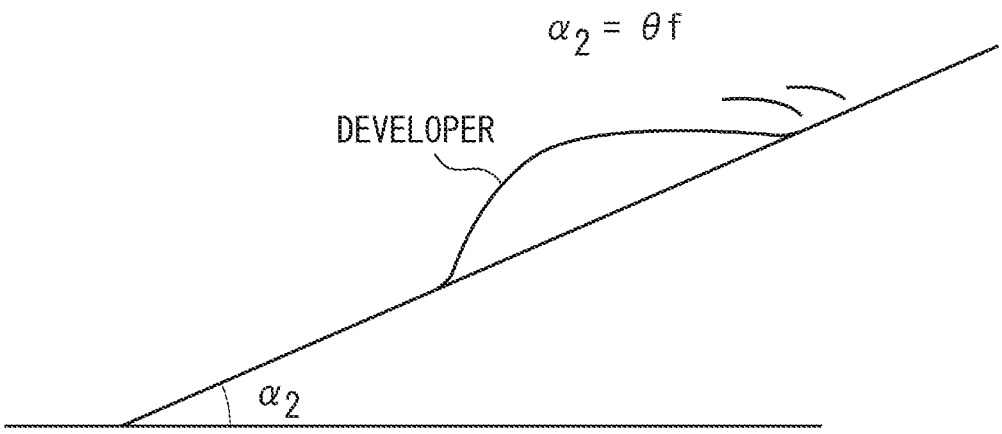
FIG. 12 illustrates a method for measuring the wall surface friction angle θf.

A method for measuring the friction coefficient "μ" described above will be introduced. First, with reference to FIG. 12 illustrating a force applied to a clot "D" of the developer on a surface of a slope, a relationship between the friction coefficient "μ" and the wall surface friction angle θf will be described. FIG. 12 illustrates a state in which the clot "D" of the developer moving in an integrated manner and having a certain quantity "m" is placed on the surface of the slope tilting by an angle θ from a horizontal plane. When the developer "D" stands still on the surface of the slope as illustrated in FIG. 12, forces stay in balance, so that the following equations are satisfied.

$$Mg \sin\theta = \mu mg \cos\theta$$

$$\mu = \sin\theta/\cos\theta = \tan\theta$$

Thus, the friction coefficient "μ" is expressed by a tangent of the angle θ between the surface of the slope and the horizontal plane. If the angle θ is increased, at a certain point, the developer slips down on the surface of the slope. The angle at this point is referred to as the wall surface friction angle θf. In other words, if the wall surface friction angle θf is measured, the friction coefficient "μ" can be acquired.

Figure 13:
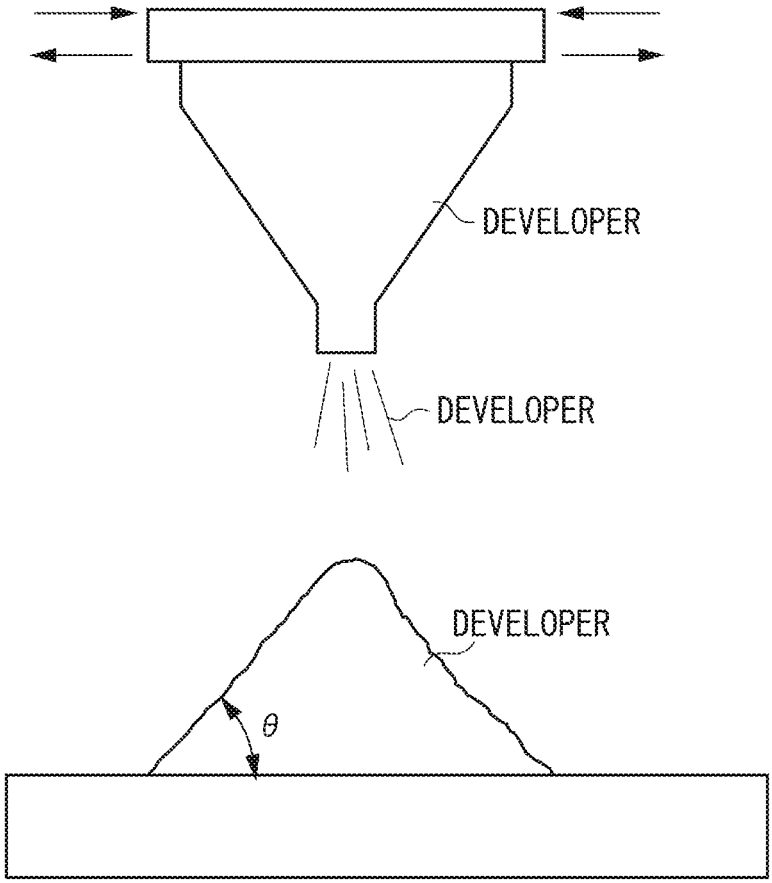
FIG. 13 illustrates a method for measuring a repose angle ϕ.

Subsequently, with reference to FIG. 13, a method for measuring the wall surface friction angle θf will be described. As a method for measuring the wall surface friction angle θf, the developer container on which the developer "D" is placed is slowly tilted. The angle α between the developer container and the horizontal plane is measured when the developer "D" starts to slip in an integrated manner. The angle α is the wall surface friction angle θf between the developer and the inner wall of the developer container. At this point, if a too small amount of the developer "D" is placed, a necessary value cannot be acquired.

If a too much amount of the developer "D" is placed, the developer "D" exceeds the repose angle ϕ and collapses, and thus it is difficult to specify a moment when the developer "D" starts to slip in an integrated manner. Therefore, as the amount of the developer "D" to be placed, 10 g is specified for the measurement of the present invention. After the first measurement, since the developer thinly covers the wall surface, the result of a second measurement is greatly different from the first measurement result. Thus, the result after the second measurement is adopted as the measurement result.

In the present exemplary embodiment, the developer container of a vertical, stirring type is used, however, the container is not limited thereto. The developing chamber 23 and the stirring chamber 24 may also be disposed in a horizontal direction.

Further, a conveyance unit is not limited to the screw, and a coil and a drain-board member may be used as the conveyance unit for performing drain-board conveyance.

Furthermore, the present invention may be applied to the developing apparatus of a trickle type in which the developer is exchanged by discharging the developer via an outlet provided in the developer container.

According to the second exemplary embodiment, it is characterized in that the friction coefficient "μ" is decreased by coating the surface of the inner walls at the upstream side of the developing chamber in the developer conveyance direction and at the downstream side of the stirring chamber in which the amount of the developer is to be relatively decreased. With this arrangement, the amount of the developer is relatively decreased in the above-described region, which reduces the uneven distribution of the developer.

Figure 14:
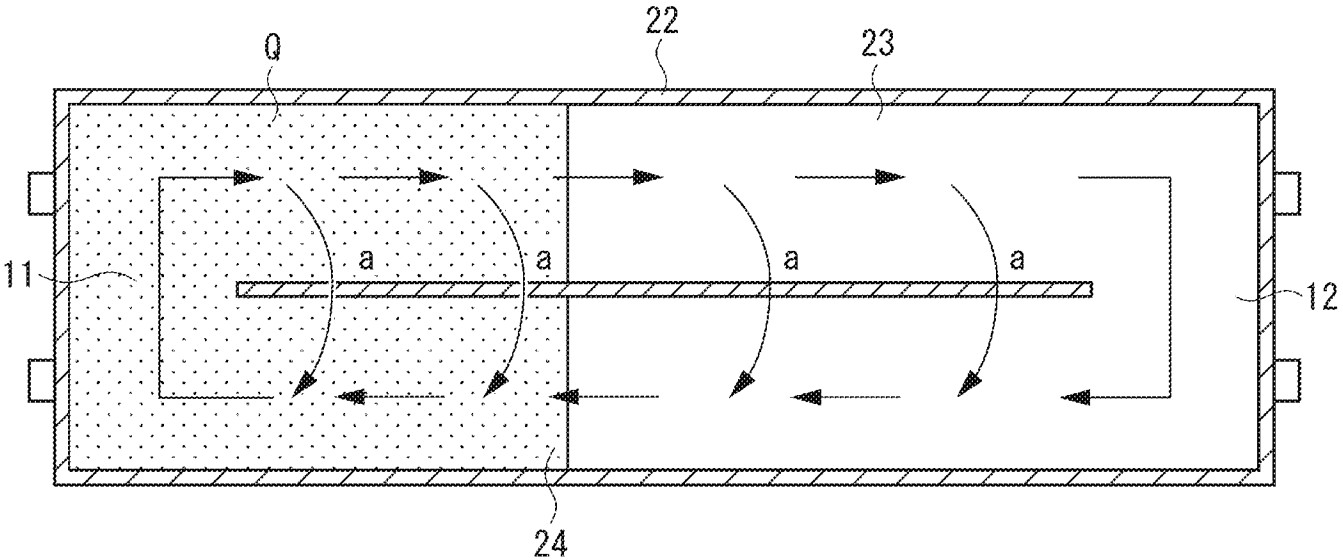
FIG. 14 illustrates a developing apparatus according to a second exemplary embodiment.

FIG. 14 is a cross-sectional view illustrating the developer container according to the present exemplary embodiment. The friction coefficient "μ" of the wall surface in a region "Q" is decreased by coating fluorine having the lower friction coefficient than the inner wall of the developing container in the region "Q". The region "Q" is the inner walls at the upstream side of the developer conveyance direction of the developer container and at the downstream side of the stirring chamber. With this arrangement, the friction coefficient "μ" in the region "Q" is decreased by 40% compared to the surface of the inner wall that is not coated with fluorine. Accordingly, the speed for conveying the developer in the region "Q" is relatively increased compared to the regions on which fluorine is not coated, thereby decreasing the amount of the developer per unit of time.

On the other hand, in the region on which fluorine is not coated, the speed for conveying the developer is relatively decreased, and thus, the amount of the developer per unit of time is increased. Therefore, the uneven distribution of the developer in the developer container is reduced.

According to the present exemplary embodiment, the friction coefficient "μ" is decreased, and thus, the flowability of the developer is more improved compared to the first exemplary embodiment. Even when the repose angle ϕ is small, the following expression is satisfied.

$$\text{wall surface friction angle } \theta f \lesssim \text{repose angle } \phi$$

Accordingly, effects of reducing the uneven distribution of the developer can be easily acquired.

The coating is not limited to fluorine, and any method may be used to decrease the friction coefficient of the inner wall using metal coating. According to the present exemplary embodiment, by varying the surface roughness of the inner wall in the developer container, the uneven distribution of the developer is reduced, however, the method is not limited thereto. For example, if the surface roughness of the developing screw for conveying the developer in the developer container is varied in the developer conveyance direction, the similar effect can be acquired. However, when the surface roughness of the developing screw is varied, the relationship between the roughness and the conveyance force becomes opposite to the case where the surface roughness of the inner wall in the developer container is varied.

More specifically, the harder the surface roughness of the developing screw, the higher the conveyance force of the developer. Further, as the flowability of the developer decreases, the conveyance force is increased. Therefore, for example, when the surface roughness of the conveyance screw provided in the developing chamber is varied, the surface roughness of the conveyance screw is set smaller at the downstream portion than at the upstream portion in the developer conveyance direction. According to the present exemplary embodiment, the surface roughness of the inner walls of both the developer container and the stirring chamber is varied. However, the present invention is not limited thereto. For example, either one of the surface roughness of the developer container and the stirring chamber may be varied.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-135099 filed Jun. 17, 2011, which is hereby incorporated by reference herein in its entirety.

What is claimed is:

1. A developing apparatus comprising:

a developer carrier configured to carry developer including toner and carrier, and develop an electrostatic latent image at a development position;

a developer container, which is separated to be segmented into a developing chamber for supplying the developer to the developer carrier, and a stirring chamber for collecting the developer to be stirred from the developer carrier, and in which a circulation path is formed to communicate with the developing chamber and the stirring chamber at their both ends to circulate the developer; and a conveyance unit provided in each of the developing chamber and the stirring chamber configured to convey and circulate the developer in the developing chamber and the stirring chamber, wherein an average surface roughness of an inner wall surface region of the developing chamber facing at least a developer carrying region of the developer carrier is smaller on an upstream side than on a downstream side with reference to a middle position of the development position in a direction of conveying the developer in the developing chamber.

2. The developing apparatus according to claim 1, wherein the surface roughness of the inner wall of the developing chamber becomes larger, step by step, from an upstream side to a downstream side in a developer conveyance direction.

3. The developing apparatus according to claim 1, wherein the surface roughness of the inner wall of the stirring chamber becomes smaller, step by step, from an upstream side to a downstream side in a developer conveyance direction.

4. The developing apparatus according to claim 1, wherein the developing chamber and the stirring chamber are disposed in a vertical direction.

5. A developing apparatus comprising:

a developer carrier configured to carry developer including toner and carrier, and develop an electrostatic latent image at a development position;

a developer container, which is separated to be segmented into a developing chamber for supplying the developer to the developer carrier and a stirring chamber for collecting the developer to be stirred from the developer carrier, and in which a circulation path is formed to communicate with the developing chamber and the stirring chamber at their both ends to circulate the developer; and a conveyance unit, provided in each of the developing chamber and the stirring chamber, configured to convey and circulate the developer in the developing chamber and the stirring chamber, wherein an average surface roughness of an an inner wall surface region of the stirring chamber facing at least a developer carrying region of the developer carrier is greater on an upstream side than on a downstream side with reference to a middle position of the development position in a direction of conveying the developer in the stirring chamber.

6. A developing apparatus comprising:

a developer carrier configured to carry developer including toner and carrier, and develop an electrostatic latent image at a development position;

a developer container, which is separated to be segmented into a developing chamber for supplying the developer to the developer carrier and a stirring chamber for collecting the developer to be stirred from the developer carrier, and in which a circulation path is formed to communicate with the developing chamber and the stirring chamber at their both ends to circulate the developer; and a conveyance member, rotatably provided in each of the developing chamber and the stirring chamber, configured to convey and circulate the developer in the developing chamber and the stirring chamber, wherein an average surface roughness of a region of the conveyance member provided in the developing chamber, facing at least a developer carrying region of the developer carrier is greater on an upstream side than on a downstream side with reference to a middle position of the development position in a direction of conveying the developer in the developing chamber.

7. A developing apparatus comprising:

a developer carrier configured to carry developer including toner and carrier, and develop an electrostatic latent image at a development position;

a developer container, which is separated to be segmented into a developing chamber for supplying the developer to the developer carrier and a stirring chamber for collecting the developer to be stirred from the developer carrier, and in which a circulation path is formed to communicate with the developing chamber and the stirring chamber at their both ends to circulate the developer; and a conveyance unit, provided in each of the developing chamber and the stirring chamber, configured to convey and circulate the developer in the developing chamber and the stirring chamber, wherein an average surface roughness of a region of the conveyance member provided in the stirring chamber, facing at least a developer carrying region of the developer carrier is smaller on an upstream side than on a downstream side with reference to a middle position of the development position in a direction of conveying the developer in the stirring chamber.

* * * * *